US008919823B2

(12) United States Patent
Hsiao

(10) Patent No.: US 8,919,823 B2
(45) Date of Patent: Dec. 30, 2014

(54) DRAINAGE FITTING FOR AIR-CONDITIONER DRAINAGE DEVICE

(75) Inventor: Yu-Ming Hsiao, Taichung (TW)

(73) Assignee: Holimay Corporation, Taichung (TW)

( * ) Notice: Subject to any disclaimer, the term of this patent is extended or adjusted under 35 U.S.C. 154(b) by 1055 days.

(21) Appl. No.: 12/662,060

(22) Filed: Mar. 30, 2010

(65) Prior Publication Data

US 2011/0174714 A1 Jul. 21, 2011

(30) Foreign Application Priority Data

Jan. 15, 2010 (TW) ..... 99200941 U

(51) Int. Cl.
*F24F 13/22* (2006.01)

(52) U.S. Cl.
CPC ..... *F24F 13/222* (2013.01); *F24F 2013/227* (2013.01)
USPC ..... 285/325; 285/41; 285/67; 285/124.3; 285/208

(58) Field of Classification Search
USPC ..... 285/24, 27, 41, 67, 325, 103, 124.2, 285/124.3, 124.4, 208
See application file for complete search history.

(56) References Cited

U.S. PATENT DOCUMENTS

| | | | | |
|---|---|---|---|---|
| 3,869,000 | A * | 3/1975 | English | 166/380 |
| 4,037,654 | A * | 7/1977 | Lien | 166/85.2 |
| 6,328,344 | B1 * | 12/2001 | Tozaki et al. | 285/93 |
| 6,666,613 | B2 * | 12/2003 | Wu | 403/299 |
| 2006/0157978 | A1 * | 7/2006 | Szabo et al. | 285/305 |
| 2008/0290654 | A1 * | 11/2008 | Sawada | 285/93 |

* cited by examiner

*Primary Examiner* — Aaron Dunwoody
*Assistant Examiner* — Fannie Kee
(74) *Attorney, Agent, or Firm* — Bacon & Thomas, PLLC

(57) ABSTRACT

A drainage fitting is mounted to an air-conditioner drainage device having a waste collector provided with an inlet and an outlet. The drainage fitting is composed of a drainage connector having an annular protrusion externally and defining an upper part and a lower part, between which the annular protrusion is located, the lower part being mounted inside the outlet, the annular protrusion being stopped against the waste collector; at least two guide members being fixed to the waste collector and located at two opposite sides around the outlet and each having a guide recess facing the other, and a locating member having a hollow portion, against which the upper part of the drainage connector can be stopped, and having two sides inserted into the guide recesses to lie against the annular protrusion.

5 Claims, 7 Drawing Sheets

DRAINAGE FITTING FOR AIR-CONDITIONER DRAINAGE DEVICE

BACKGROUND OF THE INVENTION

1. Field of the Invention

The present invention relates generally to a drainage system, and more particularly, to a drainage fitting for an air-conditioner drainage device.

2. Description of the Related Art

Currently, the commercially available split-type air conditioners include indoor and outdoor ones. If a user chooses to install the indoor air conditioner, the waste water generated by the air conditioner needs to be not subject to any location and direction, such that it is necessary to additionally install an air-conditioner drainage device. Referring to FIGS. 1-2, a commercially available air-conditioner drainage device 90 includes a waste collecting box 92 and a pump 93. The waste collecting box 92 has an inlet 922, through which the waste water can flow into the waste collecting box 92, and an outlet 924, through which the waste water can flow out of the waste collecting box 92. The pump 93 is fixed to the waste collecting box 92 for providing power driving the waste water to flow through the outlet 924 from the waste collecting box 92 and then exhaust outside. The waste water of the indoor air conditioner is guided into the waste collecting box 92 through a flexible tube 94 connected with a drainage fitting 95,96 located at the outlet 924 and fixed onto the waste collecting box 92. There are two conventional ways of connection between the drainage fitting 95,96 and the waste collecting box 92. The drainage fitting 95 is screwed with the waste collecting box 92, as shown in FIG. 1. The drainage fitting 96 is engaged between two convex pieces 97 to be fixed to the waste collecting box 92, as shown in FIG. 2. However, such two conventional ways of connection have drawbacks. If the drainage fitting 95,96 is accidentally forced to turn against the tightening direction, the drainage fitting 95,96 will be separated form the waste collecting box 92 in such a way that the waste water will leak therefrom.

SUMMARY OF THE INVENTION

The primary objective of the present invention is to provide a drainage fitting for an air-conditioner drainage device; the drainage fitting will not be accidentally forced for separation and thus avoid leakage.

The foregoing objective of the present invention is attained by the drainage fitting mounted to the air-conditioner drainage device. The air-conditioner drainage device includes a waste collector and a pump. The waste collector is provided with an inlet, through which the waste water produced by an air conditioner can flow into the waste collector, and an outlet, through which the waste water can flow out of the waste collector. The pump is fixed to the waste collector for providing power driving the waste water to flow to the outlet from waste collector. The drainage fitting is composed of an elongated drainage connector, at least two guide members, and a locating member. The drainage connector includes a passage internally and an annular protrusion externally. The drainage connector defines an upper part and a lower part, between which the annular protrusion is located. The lower part is mounted inside the outlet and the annular protrusion is stopped against the waste collector. The at least two guide members are fixed to the waste collector and located at two opposite sides around the outlet and each has a guide recess facing the other. The locating member includes a hollow portion, at which the upper part of the drainage connector can be stopped against the hollow portion. The locating member is inserted into the guide recesses to lie against the annular protrusion. Accordingly, even if the drainage connector is accidentally forced to rotate, the locating member keeps pressing the annular protrusion to prevent the drainage connector from separation from the waste collector.

DETAILED DESCRIPTION OF PREFERRED EMBODIMENTS

Figure 1:
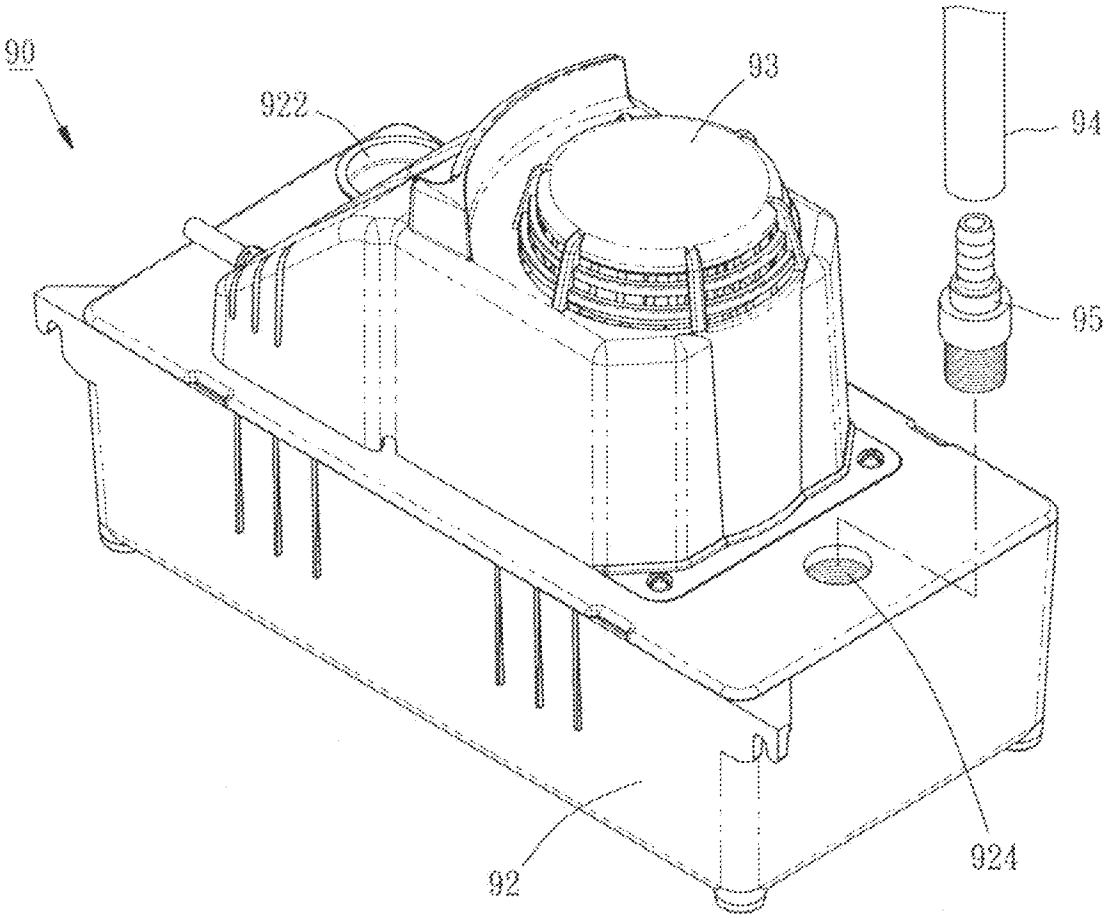
FIG. 1 PRIOR ART
FIG. 1 is a perspective view of a conventional air-conditioner drainage device.
Figure 2:
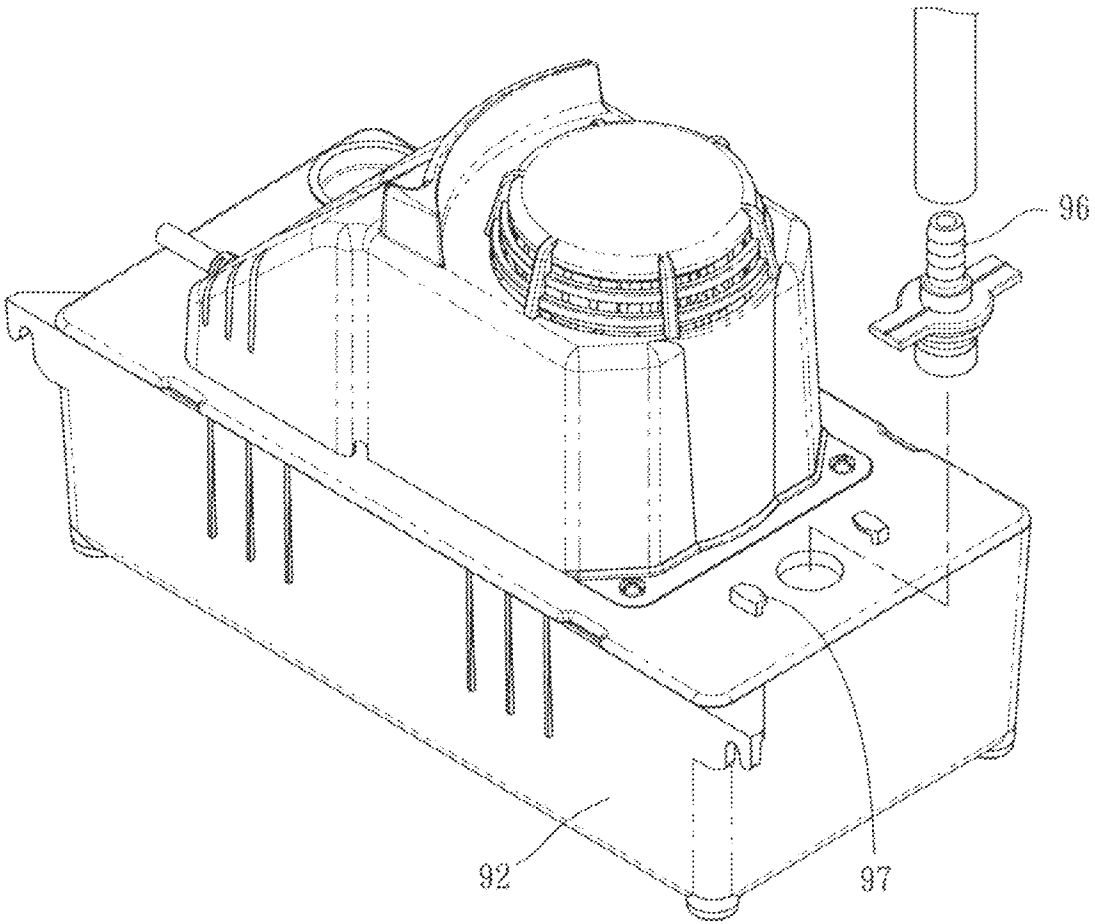
FIG. 2 PRIOR ART
FIG. 2 is a perspective view of another conventional air-conditioner drainage device.
Figure 3:
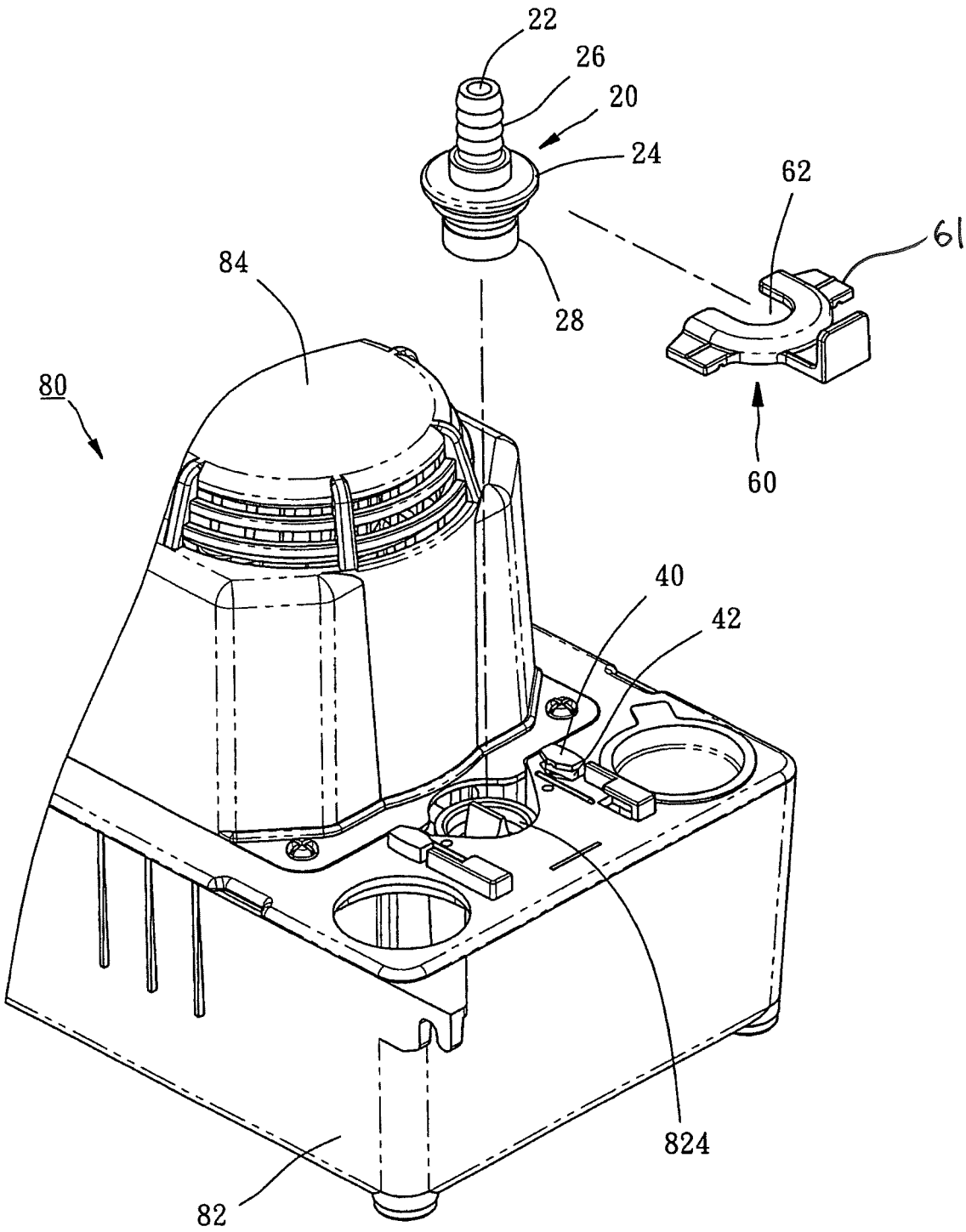
FIG. 3 is an exploded view of a first preferred embodiment of the present invention.
Figure 4:
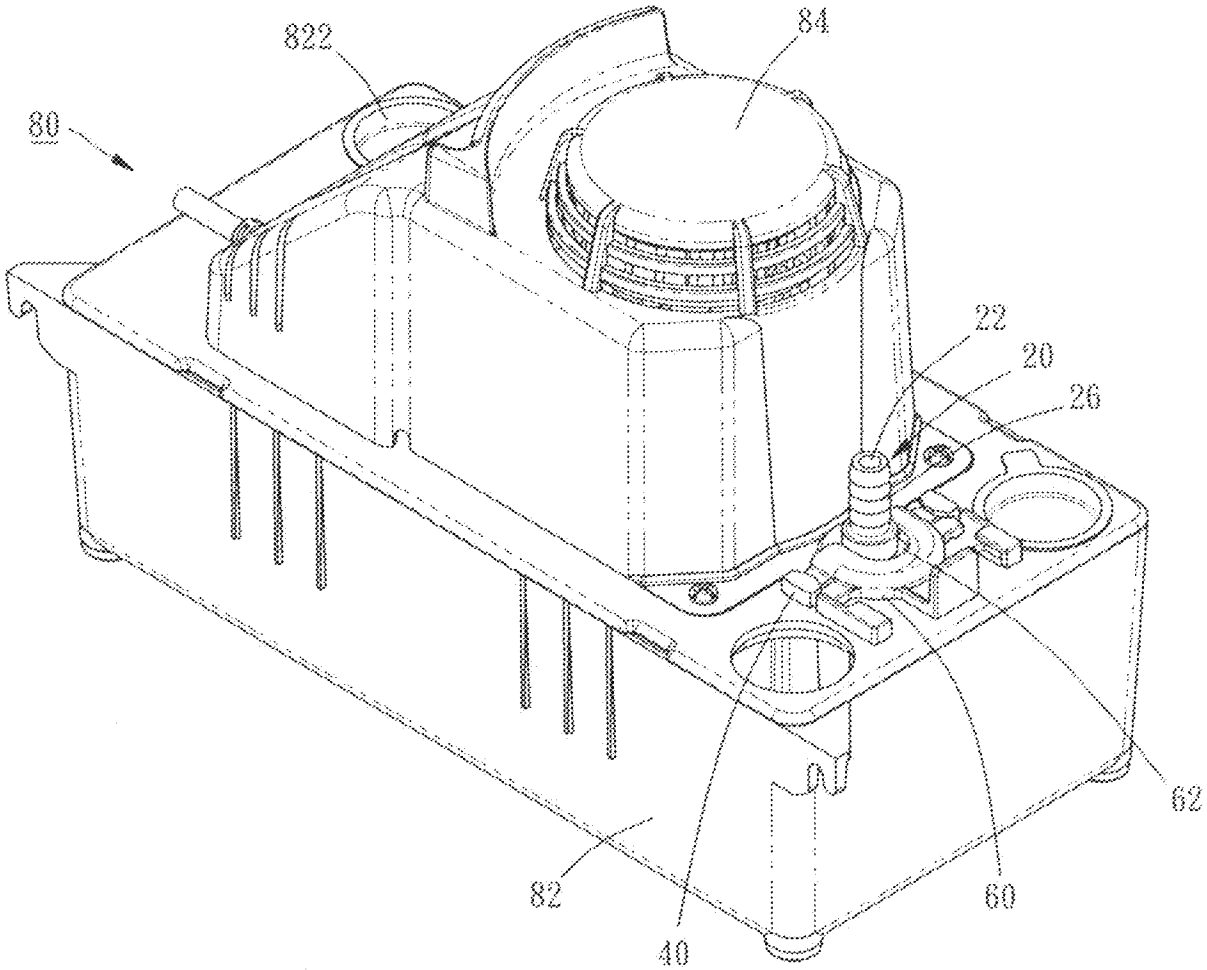
FIG. 4 is a perspective view of the first preferred embodiment of the present invention, illustrating that the locating member is stopped against the upper part of the drainage connector when it is intended to combine the drainage connector and the waste collector.
Figure 5:
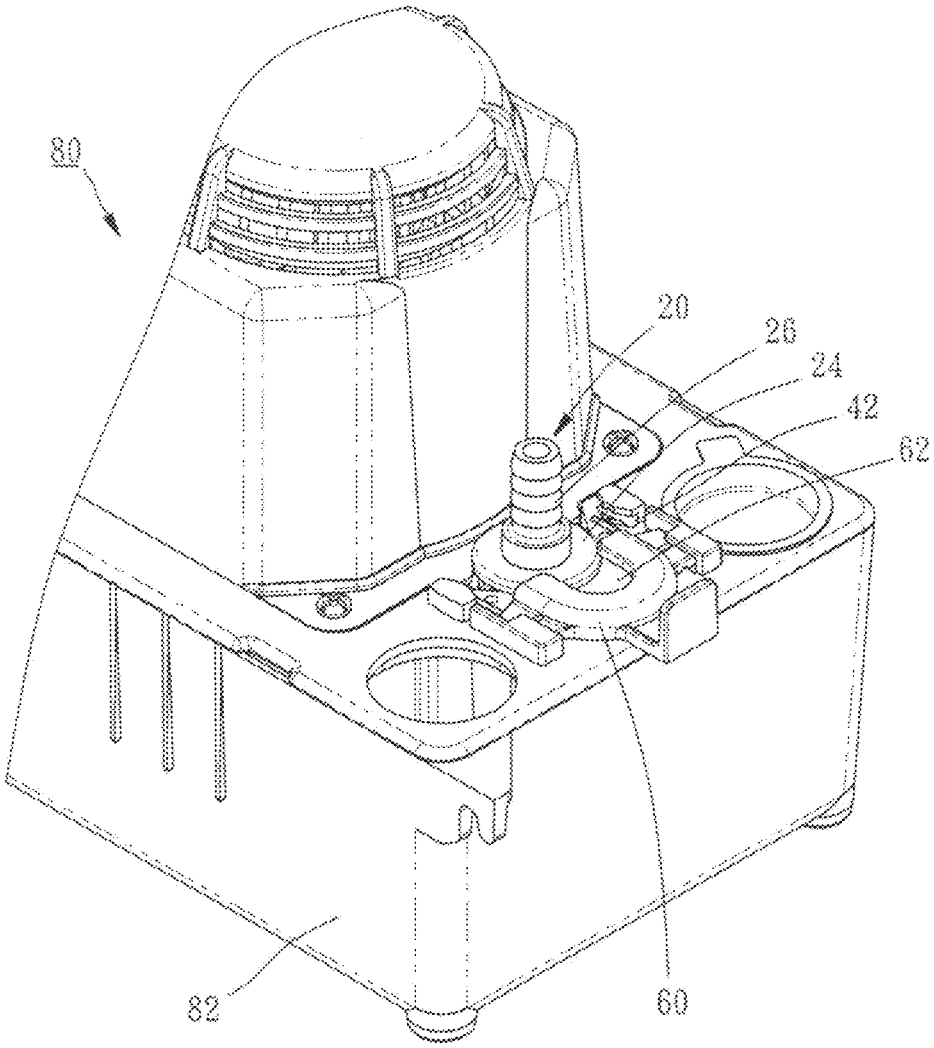
FIG. 5 is another perspective view of the first preferred embodiment of the present invention, illustrating that the locating member is separated from the upper part of the drainage connector when it is intended to separate the drainage connector from the waste collector.

Referring to FIGS. 3-5, a drainage fitting in accordance with a first preferred embodiment of the present invention is mounted to the air-conditioner drainage device 80. The air-conditioner drainage device 80 is composed of a waste collector 82 and a pump 84. The waste collector 82 includes an inlet 822 and outlet 824. The inlet 822 is provided for waste water produced by an air conditioner (not shown) to flow into the waste collector 82. The outlet 824 is provided for the waste water to flow out of the waste collector 82. The pump 84 is fixed to the waste collector 82 for providing power driving the waste water to flow to the outlet 824 from the waste collector 82. The present invention is characterized in that the drainage fitting is composed of an elongated drainage connector 20, two guide members 40, and a locating member 60. These components are structurally illustrated in details as well as their interrelationships in the following respective paragraphs.

The drainage connector 20 includes a passage 22 internally and an annular protrusion 24 externally and defines an upper part 26 and a lower part 28, between which the annular protrusion 24 is located. The lower part 28 is mounted in the outlet 824. The annular protrusion 24 lies against the waste collector 82.

Each of the guide members 40 is fixed to the waste collector 82 and located at one of opposite sides around the outlet 824, having a guide recess 42 formed at one side facing that of the other guide member 40.

The locating member 60 includes a hollow portion 62, which can be stopped against the upper part 26 of the drainage connector 20. The locating member 60 can have its two sides be inserted into the guide recesses 42 respectively to oppressively lie against the annular protrusion 24. The locating member 60 further includes two wings 61. Each wing 61 is located on a side of the locating member such that the two wings are inserted into the guide recesses, respectively.

When it is intended to combine the drainage connector 20 and the waste collector 82, move the locating member 60 to allow the hollow portion 62 to be stopped against the upper part 26 of the drainage connector 20 and to have its two sides be inserted into the guide recesses 42 respectively in such a way that the locating member 60 can be oppressively lie against the annular protrusion 24. In this way, even if the drainage connector 20 is accidentally turned, the drainage connector 20 will not be separated from the waste collector 82 because the locating member 60 keeps lying against the annular protrusion 24, thus preventing the waste water from leakage. When it is intended to separate the drainage connector 20 from the waste collector 82, move the locating member 60 away from the guide recesses 42 of the guide members 40 to allow the upper part 26 of the drainage connector 20 to separate from the hollow portion 62, such that the drainage connector 20 can be separated from the waste collector 82.

Figure 6:
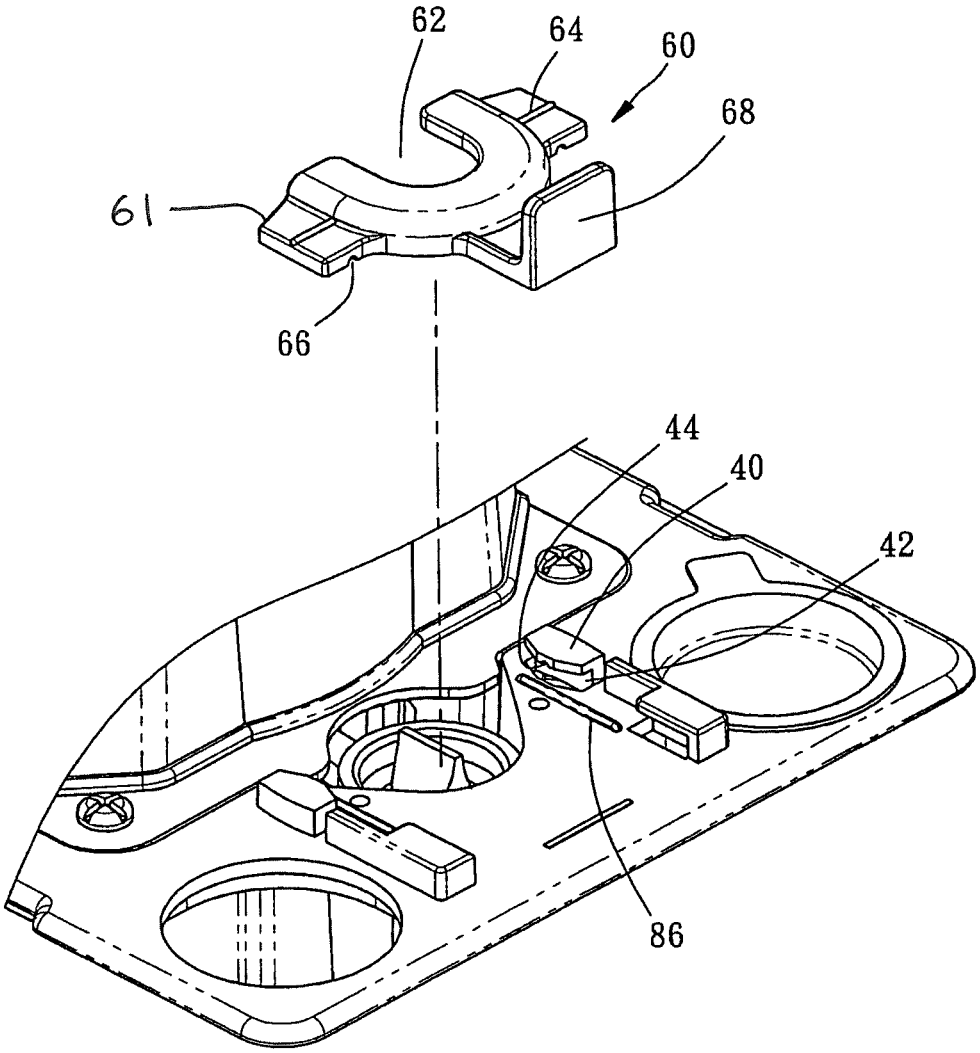
FIG. 6 is a perspective view of a part of a second preferred embodiment of the present invention.
Figure 7:
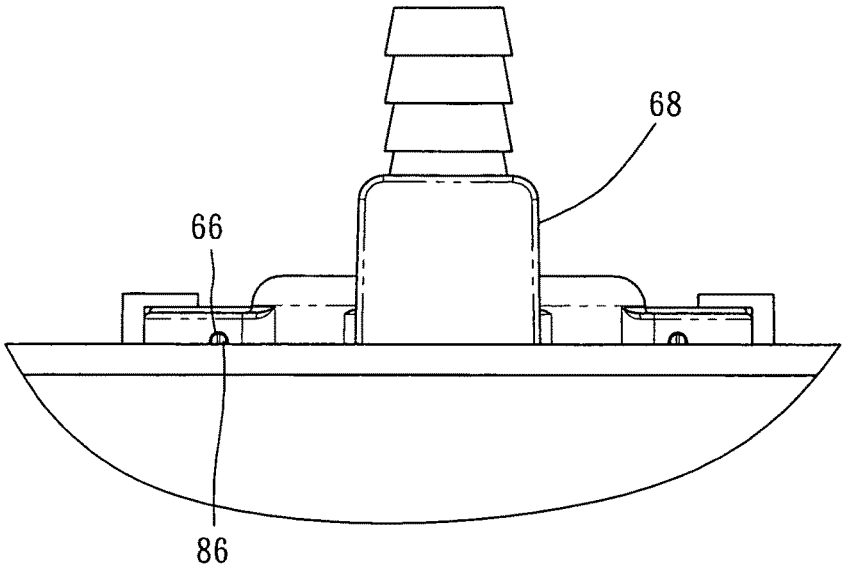
FIG. 7 is a sectional view of another part of the second preferred embodiment of the present invention.

Referring to FIGS. 6-7, a drainage fitting in accordance with a second preferred embodiment of the present invention is similar to that of the first embodiment of the present invention, having the difference recited below.

Each of the guide members 40 includes a guide cavity 44. The waste collector 82 includes two guide rails 86 located between the guide cavities 44 and around the outlet 824. The locating member 60 further includes two locating ribs 64 and two guideways 66. Each of the locating ribs 64 corresponds to and can engage one of the two guide cavities 44 to avoid free movement of the locating member 60 and to keep oppressively lying against the annular protrusion 24. Each of the guideways 66 corresponds to one of the two guide rails 86. The locating member 60 can be moved along the guide rails 86 by means of the guideways 66. Besides, the locating member 60 further includes a handhold 68 for the user to conveniently move the locating member 60.

Figure 8:
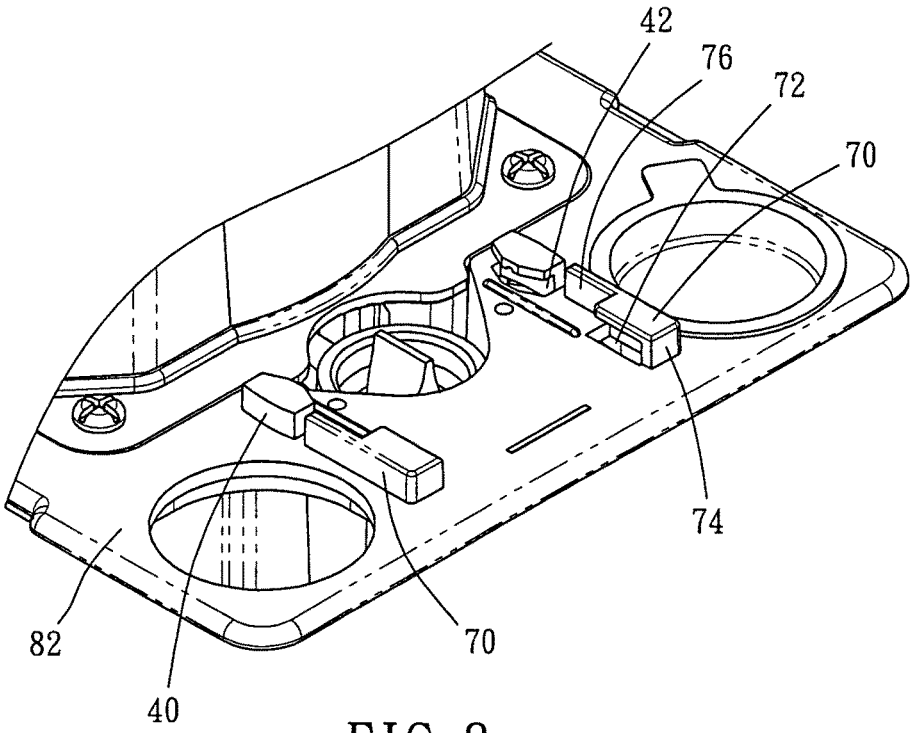
FIG. 8 is a sectional view of another part of a third preferred embodiment of the present invention.

Referring to FIG. 8, a drainage fitting in accordance with a third preferred embodiment of the present invention is different from that of the second embodiment of the present invention in that the drainage fitting further includes two limiting members 70 corresponding to the guide recesses 42 respectively. The two limiting members 70 are fixed to the waste collector 82 and each includes a limiting recession 72 corresponding to one of the guide recesses 42. When the locating member 60 disengages from the guide recesses 42, the locating member 60 is moved along the limiting recessions 72.

In addition, for preventing the locating member 60 from separation from the limiting recessions 72 while the user operates the drainage fitting of the third embodiment, the drainage fitting further includes two stopping pieces 74 each fixed to one end of one of the limiting members 70. Each of the limiting members 70 includes an uncovered portion 76 for the locating member 60 to enter and exit the limiting recessions 72. The operation of the third embodiment is similar to that of the first embodiment and different in that the locating member 60 needs to enter the limiting recessions 72 through the uncovered portions 76 and then move along the limiting recessions 72 when it is intended to combine the drainage connector 20 and the waste collector 82. On the contrary, the locating member 60 needs to move along the limiting recessions 72 and then exit the limiting recessions 72 through the uncovered portions 76 when it is intended to separate the drainage connector 20 from the waste collector 82.

In conclusion, the present invention can avoid leakage of the waste water from the waste collector 82 by that the locating member 60 keeps oppressively lying against the annular protrusion 24 to disable the drainage connector 20 from separation from the waste collector 82 while the drainage connector 20 is accidentally forced to turn.

Although the present invention has been described with respect to specific preferred embodiments thereof, it is in no way limited to the specifics of the illustrated structures but changes and modifications may be made within the scope of the appended claims.

What is claimed is:

1. A drainage fitting configured for mounting to an air-conditioner drainage device having a waste collector and a pump, the waste collector having an inlet and an outlet for air-conditioning waste water to flow into and out of the waste collector respectively, the pump being fixed to the waste collector for driving the waste water to flow to the outlet from the waste collector, the drainage fitting comprising:

an elongated drainage connector having a passage internally and an annular protrusion externally, the drainage connector defining an upper part and a lower part, between which the annular protrusion is located, the lower part being configured to be mounted in the outlet, the annular protrusion being configured to lie against the waste collector;

at least two guide members configured to be fixed to the waste collector and located at opposite sides thereof around the outlet, each of the guide members having a guide recess with a bottom portion facing the other, wherein the at least two guide members are located on an upper surface of the waste collector and at two opposite sides of the outlet; and a locating member having a hollow portion stopped against the upper part of the drainage connector, the locating member having two sides inserted into the guide recesses respectively to be oppressively stopped against the annular protrusion, wherein the locating member includes two wings at two sides thereof such that the two wings are inserted into the guide recesses, respectively.

2. The drainage fitting as defined in claim 1, wherein each of the at least two guide members comprises at least one guide cavity; the waste collector comprises two guide rails formed between the guide cavities and around the outlet; the locating member comprises at least two locating ribs and at least two guideways, the at least two locating ribs corresponding to the at least one guide cavity, the at least two guideways corresponding to the guide rails respectively, the locating ribs being engaged with the guide cavities respectively, whereby the locating member is movable along the guide rails by the at least two guideways.

3. The drainage fitting as defined in claim 2, wherein the locating member comprises a handhold.

4. The drainage fitting as defined in claim 1 further comprising at least two limiting members, wherein each of the limiting members corresponds to one of the at least two guide members to be fixed to the waste collector and comprises a limiting recession corresponding to one of the guide recesses.

5. The drainage fitting as defined in claim 4 further comprising two stopping pieces, wherein each of the two stopping pieces is fixed to one end of one of the limiting members, each of the limiting members having an uncovered portion for the locating member to enter and exit the limiting recessions.

* * * * *